United States Patent [19]

Bradford

[11] Patent Number: 4,538,429

[45] Date of Patent: Sep. 3, 1985

[54] LOBE-PINCHING EARRING WHICH SIMULATES PIERCING EARRING

[76] Inventor: Darlyne J. Bradford, 1702 McKinley, Des Moines, Iowa 50315

[21] Appl. No.: 568,343

[22] Filed: Jan. 5, 1984

[51] Int. Cl.[3] ..... A44C 7/00

[52] U.S. Cl. ..... 63/14 G; 63/14 R; 24/237

[58] Field of Search ..... 63/14 R, 14 A, 14 B, 63/14 C, 14 D, 14 E, 14 F, 14 G; 24/30.5 S, 237, 530, 545, 546, 555

[56] References Cited

U.S. PATENT DOCUMENTS

| | | | |
|---|---|---|---|
| 1,208,663 | 12/1916 | Rueckert | 63/14 B X |
| 2,282,336 | 5/1942 | Meyer | 63/14 G |
| 3,164,250 | 1/1965 | Paxton | 24/30.5 S X |
| 3,614,876 | 10/1971 | Lenfant | 63/14 G |
| 4,277,434 | 7/1981 | Conway | 24/237 X |

FOREIGN PATENT DOCUMENTS

| | | | |
|---|---|---|---|
| 925311 | 5/1973 | Canada | 63/14 G |
| 895670 | 4/1944 | France | 63/14 D |
| 254327 | 5/1948 | Switzerland | 63/14 G |
| 604642 | 9/1978 | Switzerland | 24/237 |
| 899819 | 6/1962 | United Kingdom | 63/14 G |

*Primary Examiner*—F. Barry Shay

*Attorney, Agent, or Firm*—Zarley, McKee, Thomte, Voorhees & Sease

[57] ABSTRACT

An earring is constructed of a resilient ring having closely spaced apart opposite ends defining an opening therebetween for receiving an earlobe. Each of the ends terminates in a nodule for engaging the earlobe and maintaining the ring upon the lobe. The nodules have a cross-sectional area smaller than that of said ring and are not visible when the ring is in place upon the ear. Earrings of this construction can be mass produced in various sizes by an injection molding process. Liquid material solidifies into concentric cavities of the mold to form interconnected concentric earrings which can then be separated from one another for the finished product.

9 Claims, 6 Drawing Figures

LOBE-PINCHING EARRING WHICH SIMULATES PIERCING EARRING

BACKGROUND OF THE INVENTION

Pierced earrings are commonplace in today's society for people who have pierced ears. Pierced ears, however, present some health hazards including infection and tearing of the earlobe if the earring should be accidentally snagged. Conventional clip-on earrings worn on unpierced ears have problems such as the clip failing. Also, clip-on earrings typically utilize an enlarged surface area to clamp the earlobe which can cause discomfort to the wearer.

Also, it is economically desirable that a manufacturer of earrings be able to mass produce the earrings, and more particularly, to mass product them in various sizes.

Therefore, a primary objective of the present invention is the provision of an earring to be worn on pierced or unpierced ears that resembles an earring for pierced ears without subjecting the wearer to the problems of pierced ears.

A further objective of the present invention is the provision of an earring which is easily secured to an earlobe and which will remain secured thereto.

Another objective of the present invention is the provision of an earring that has minimal earlobe contact.

A further objective of the present invention is the provision of a method of simultaneously mass producing earrings of various sizes for pierced or unpierced ears.

These and other objectives will become apparent from the following description.

SUMMARY OF THE INVENTION

An earring is provided that engages the earlobe wthout the need of having the lobe pierced. The ring is constructed of resilient material and has opposite ends each terminating in a nodule. The nodules are closely spaced apart to provide an opening therebetween for receiving the earlobe and engage opposite sides of the earlobe so as to secure the ring to the lobe. The nodules are of minimal size and are not visible when the earring is in place. The earrings may have any desired shape.

An injection molding process is used to manufacture the earrings. A plurality of various sized earrings are manufactured simultaneously by injecting a liquid material into a mold having a plurality of concentric cavities and allowing the liquid to solidify and to form the interconnected concentric earrings, which later can be separated into individual earrings.

DETAILED DESCRIPTION OF THE DRAWINGS

Figure 1:
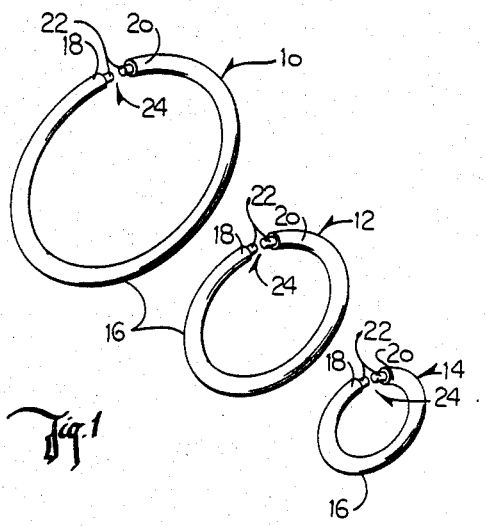
FIG. 1 is a perspective view showing separated concentric earrings.
Figure 2:
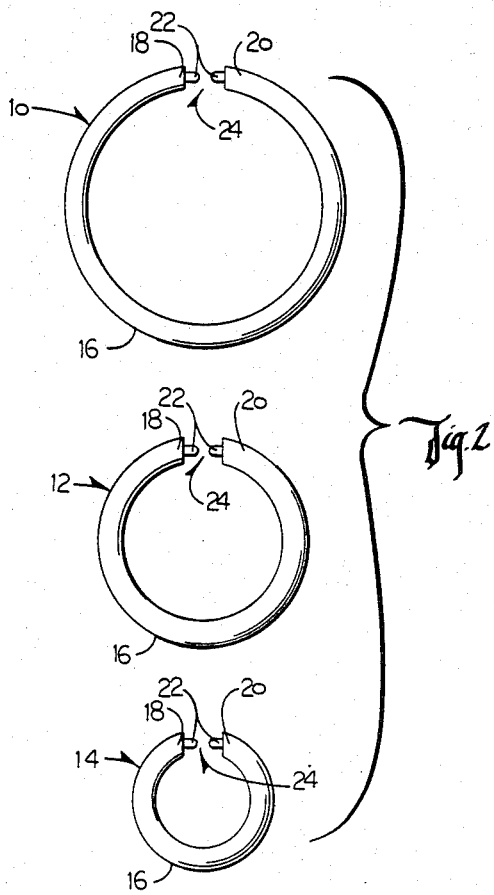
FIG. 2 is a front elevational view of the separated concentric earrings.
Figure 3:
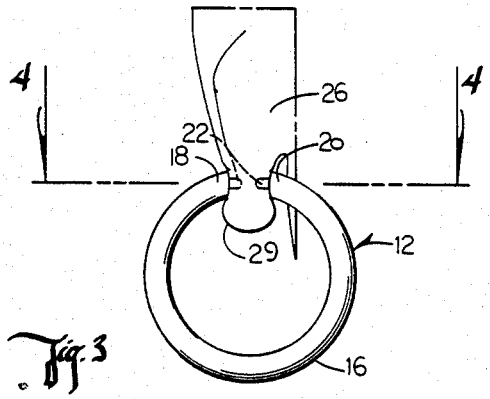
FIG. 3 is a front elevational view showing an earring in position on an earlobe.
Figure 4:
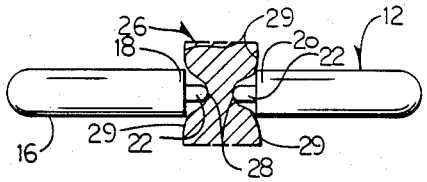
FIG. 4 is a top plan view taken along line 4—4 of FIG. 3.

A plurality of concentric earrings are generally designated by the reference numerals 10, 12, and 14 respectively. Each earring comprises a main body portion 16 having opposite ends 18 and 20. Each end has a nodule 22 integrally formed thereon having an cross-sectional area less than that of the respective end. Nodules 22 are generally round in cross-section and have a convex tip. Nodules 22 are disposed towards one another and spaced slightly apart to define an opening 24 therebetween through which an earlobe 26 can be received.

Earrings 10, 12 or 14 can be worn on a pierced or unpierced ear. The earring is made of a resilient material such that the ends 18 and 20 can be forced apart slightly so that an earlobe 26 can pass through the opening 24 between nodules 22. Upon release of ends 18 and 20, the ends will naturally spring back such that nodules 22 clamp upon earlobe 26 and securely maintain the earring in place thereon.

The reduced size of nodules 22 permit them to engage a minimum area of the earlobe, in contrast to conventional clip-on earrings which have large bearing surfaces for clamping onto the earlobe. Discomfort to the wearer is therefore minimized. Nodules 22 merely put pressure on or pinch the flesh of the earlobe together at point 28 without penetrating the skin of the earlobe. The ends 18 and 20 of the earring are coplanar with the surface 29 of the earlobe adjacent point 28 and exert essentially no pressure upon the earlobe. Because ends 18 and 20 are flush with the earlobe surface 29, nodules 22 are not visible when the earring is in place upon the earlobe.

In the preferred embodiment, the diameter of nodule 22 is 0.07 inch, the length of nodule 22 is 0.10 inch, and opening 24 is 0.06 inch. Body 16 of the earring is preferably round in cross-section. The earring may be of any general shape, including but not limited to, a square, a rectangle, an oval, a triangle, or a circle. The circular shape shown in the drawings is merely illustrative of one of the possible shapes of the earring.

Figure 5:
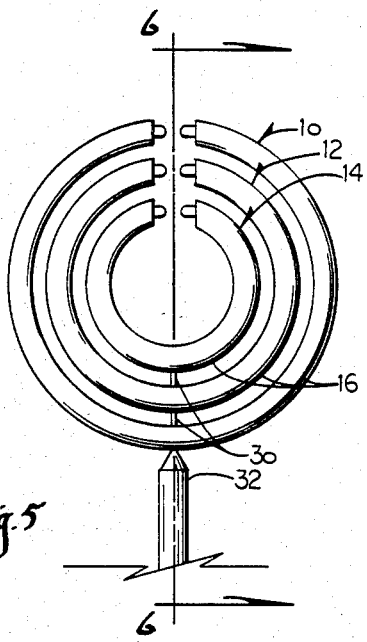
FIG. 5 is a view of the unseparated concentric earrings as they are manufactured.
Figure 6:
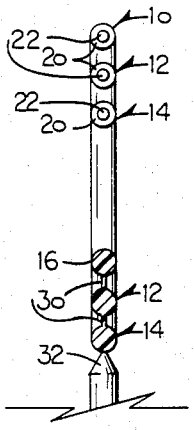
FIG. 6 is a view taken along line 6—6 of FIG. 5.

It is possible to mass produce the earrings by having the rings 10, 12 and 14 being concentric in shape, as shown in FIG. 5. A mold (not shown) can be constructed having a plurality of concentric cavities therein for forming the concentric earrings. The cavities can be injected with a liquid material which fills the cavities and passes from one ring to the next adjacent ring through a small gate. The material is allowed to solidify and the concentric earrings can then be removed from the mold. The finished product appears as in FIG. 5. The solidified material forms concentric rings 10, 12 and 14 which are interconnected by a small quantity of material 30 which solidified within the gate between cavities. This interconnecting portion 30 can be severed from the earrings such that the earrings have a smooth finish. Similarly, a second quantity of material 32 which solidified in the material inlet port of the mold can be easily removed from outer rings 10. The injection molding process thus permits a large quantity of earrings having various sizes to be mass produced.

What is claimed is:

1. An earring, comprising:

a resilient ring having closely spaced apart confronting ends defining an opening therebetween for receiving an earlobe, said earring having means for cooperating with the earlobe to retain the earring thereon by pinching the earlobe while simulating the appearance of an earring piercing the earlobe, said means including end portions terminating said ring, each said end portion having a planar surface area with a centrally projecting nodule for pressingly engaging opposite sides of said earlobe, said nodules being disposed towards one another and having a cross-sectional area sufficiently smaller than that of said end portions of said ring whereby the flesh of said earlobe engaged by the nodules is pinched together such that said planar surface areas of said ring are coplanar with the adjacent earlobe surfaces beyond said planar surface area.

2. The earring of claim 1 wherein said nodules have a convex tip.

3. The earring of claim 1 wherein said nodules are round in cross-section.

4. The earring of claim 1 wherein said ring is round in cross-section.

5. The earring of claim 1 wherein said nodules are approximately 0.07 inch in diameter.

6. The earring of claim 1 wherein said nodules are approximately 0.10 inch in length.

7. The earring of claim 1 wherein said opening is approximately 0.06 inch.

8. The earring of claim 1 wherein said opposite ends of said ring are forced apart to increase said opening therebetween whereby said ring can be placed about or removed from said earlobe.

9. The earring of claim 8 wherein said opposite ends of said ring spring toward one another when said force is released whereby said nodules clamp towards one another on said earlobe to maintain said ring in place thereon.

* * * * *